US010494241B2

(12) United States Patent
Petronek

(10) Patent No.: US 10,494,241 B2
(45) Date of Patent: Dec. 3, 2019

(54) HYDRAULIC CLAMPING SYSTEMS HAVING LOAD SIDE-SHIFTING VARIABLY RESPONSIVE TO LOAD WEIGHT

(71) Applicant: Cascade Corporation, Fairview, OR (US)

(72) Inventor: David W. Petronek, Boring, OR (US)

(73) Assignee: Cascade Corporation, Fairview, OR (US)

( * ) Notice: Subject to any disclaimer, the term of this patent is extended or adjusted under 35 U.S.C. 154(b) by 272 days.

(21) Appl. No.: 15/267,694

(22) Filed: Sep. 16, 2016

(65) Prior Publication Data

US 2018/0079634 A1 Mar. 22, 2018

(51) Int. Cl.

| | |
|---|---|
| ***B66F 9/22*** | (2006.01) |
| ***F15B 11/16*** | (2006.01) |
| ***B66F 9/14*** | (2006.01) |
| ***B66F 9/18*** | (2006.01) |

(52) U.S. Cl.

CPC ..... *B66F 9/22* (2013.01); *B66F 9/146* (2013.01); *B66F 9/183* (2013.01); *F15B 11/161* (2013.01); *F15B 11/166* (2013.01); *F15B 2211/3051* (2013.01); *F15B 2211/3059* (2013.01); *F15B 2211/30585* (2013.01); *F15B 2211/3116* (2013.01); *F15B 2211/40* (2013.01); *F15B 2211/40523* (2013.01); *F15B 2211/50518* (2013.01); *F15B 2211/528* (2013.01); *F15B 2211/575* (2013.01); *F15B 2211/67* (2013.01); *F15B 2211/7142* (2013.01); *F15B 2211/76* (2013.01); *F15B 2211/782* (2013.01)

(58) Field of Classification Search

CPC .... B66F 9/22; B66F 9/24; B66F 9/146; B66F 9/183; B66F 9/18; B25J 13/082; F15B 11/161

USPC ..... 701/50; 60/422; 414/21, 621, 623

See application file for complete search history.

(56) References Cited

U.S. PATENT DOCUMENTS

| | | | | |
|---|---|---|---|---|
| 2,663,443 A | | 12/1953 | Schenkelberger | |
| 2,795,346 A | * | 6/1957 | Farmer | B66F 9/183 254/2 R |
| 3,692,198 A | * | 9/1972 | Lake | B66F 9/183 414/621 |
| 3,865,424 A | | 2/1975 | Jabkowski | |
| 3,971,584 A | * | 7/1976 | Duncan | B66F 9/183 294/207 |
| 3,990,594 A | * | 11/1976 | Olson | B66F 9/183 414/621 |

(Continued)

OTHER PUBLICATIONS

United States Patent and Trademark Office; International Search Report and Written Opinion for International Application No. PCT/US2016/069365 dated Mar. 23, 2017; 10 pages.

*Primary Examiner* — Nathaniel E Wiehe
*Assistant Examiner* — Richard C Drake
(74) *Attorney, Agent, or Firm* — Chernoff, Vilhauer, McClung & Stenzel, LLP

(57) ABSTRACT

Different exemplary control systems for a hydraulically powered load-handling clamp, of the type usually mountable on industrial lift trucks or automatically guided vehicles, are disclosed. The disclosed systems variably limit a hydraulic force, by which load-clamping arms move a load substantially transversely, automatically depending on the weight of the load being moved, so as to avoid excessive transverse force applied to fragile loads.

8 Claims, 4 Drawing Sheets

(56) References Cited

U.S. PATENT DOCUMENTS 4,335,992 A * 6/1982 Reeves ..... B66F 9/146 414/667
4,431,365 A 2/1984 Sturtz, Jr.
4,682,931 A * 7/1987 House ..... B66F 9/184 294/206
5,984,617 A * 11/1999 Seaberg ..... B66F 9/184 294/206
6,390,751 B2 * 5/2002 Jordan ..... B25J 13/082 187/224
6,431,816 B1 * 8/2002 Jordan ..... B25J 13/082 414/636
7,056,078 B2 * 6/2006 Seaberg ..... B66F 9/184 294/87.1
7,553,120 B2 * 6/2009 Veneziani ..... F15B 11/044 137/101
8,091,467 B2 * 1/2012 Petronek ..... B66F 9/22 414/667
8,979,154 B2 * 3/2015 Petronek ..... B66F 9/183 294/192
9,221,658 B2 * 12/2015 Matti ..... B66F 9/14
2002/0131852 A1 9/2002 Jordan et al.
2003/0017040 A1 * 1/2003 Jordan ..... B25J 13/082 414/636
2006/0073001 A1 * 4/2006 Chase ..... B66F 9/183 414/621
2008/0063503 A1 * 3/2008 Garrett ..... A01D 87/122 414/729
2009/0304479 A1 * 12/2009 Lessard ..... B66F 9/183 414/21
2010/0089704 A1 * 4/2010 Petronek ..... B66F 9/183 187/224
2010/0300812 A1 * 12/2010 Hall ..... B66F 9/183 187/237
2012/0210802 A1 * 8/2012 Sarh ..... B21J 15/10 73/862.625
2014/0365009 A1 * 12/2014 Wettels ..... B25J 9/1612 700/258
2015/0368080 A1 * 12/2015 Dal Dosso ..... B66F 9/183 701/50
2016/0122167 A1 * 5/2016 White ..... B66F 9/183 414/621
2016/0243709 A1 * 8/2016 Ganz ..... B25J 9/1612

* cited by examiner

HYDRAULIC CLAMPING SYSTEMS HAVING LOAD SIDE-SHIFTING VARIABLY RESPONSIVE TO LOAD WEIGHT

CROSS-REFERENCE TO RELATED APPLICATIONS

Not applicable.

BACKGROUND OF THE INVENTION

Hydraulic load-handling clamp assemblies, of the type normally mountable on lift trucks and other industrial vehicles for manipulating and transporting loads, often have a pair of transversely openable and closable clamp arms powered by one or more linear or rotary hydraulic actuators for selectively gripping and releasing loads. Such hydraulic clamp assemblies also commonly have a selectable hydraulic side-shifting capability which can move the clamp arms transversely in unison in either of two opposite directions while clamping a load. In some of such clamp assemblies, the same hydraulic actuator(s) which perform the load-clamping function also selectively perform the side-shifting function, thereby advantageously minimizing the size and weight of the assembly. Such systems are referred to herein as "integral" load clamping and side-shifting units. Conversely, in "non-integral" systems, the clamp assembly's load-clamping hydraulic actuator(s) are movably carried by a separate side-shifting assembly having its own separate side-shifting hydraulic actuator(s).

A longstanding problem has existed with respect to both the foregoing integral and non-integral types of units, in that the above-described load-clamping function requires load clamping forces applied by both clamp arms to the load in respective opposite directions, while at the same time the side-shifting function requires side-shifting forces applied by both clamp arms in the same direction. The result is that the bidirectional clamping force is automatically diminished by the simultaneous unidirectional side-shifting force, thereby enabling a clamped load to slip and fall from the clamp during side-shifting if the side-shifting force is too great relative to the clamping force. The most problematic situation of this type occurs when limited hydraulic clamping force is already being applied to grip a fragile load to avoid overclamping damage to the load, at the same time that the hydraulic side-shifting force is not being sufficiently limited due to the damp operator's desire for rapid side-shifting.

The foregoing summary will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Integral Embodiments

Figure 1:
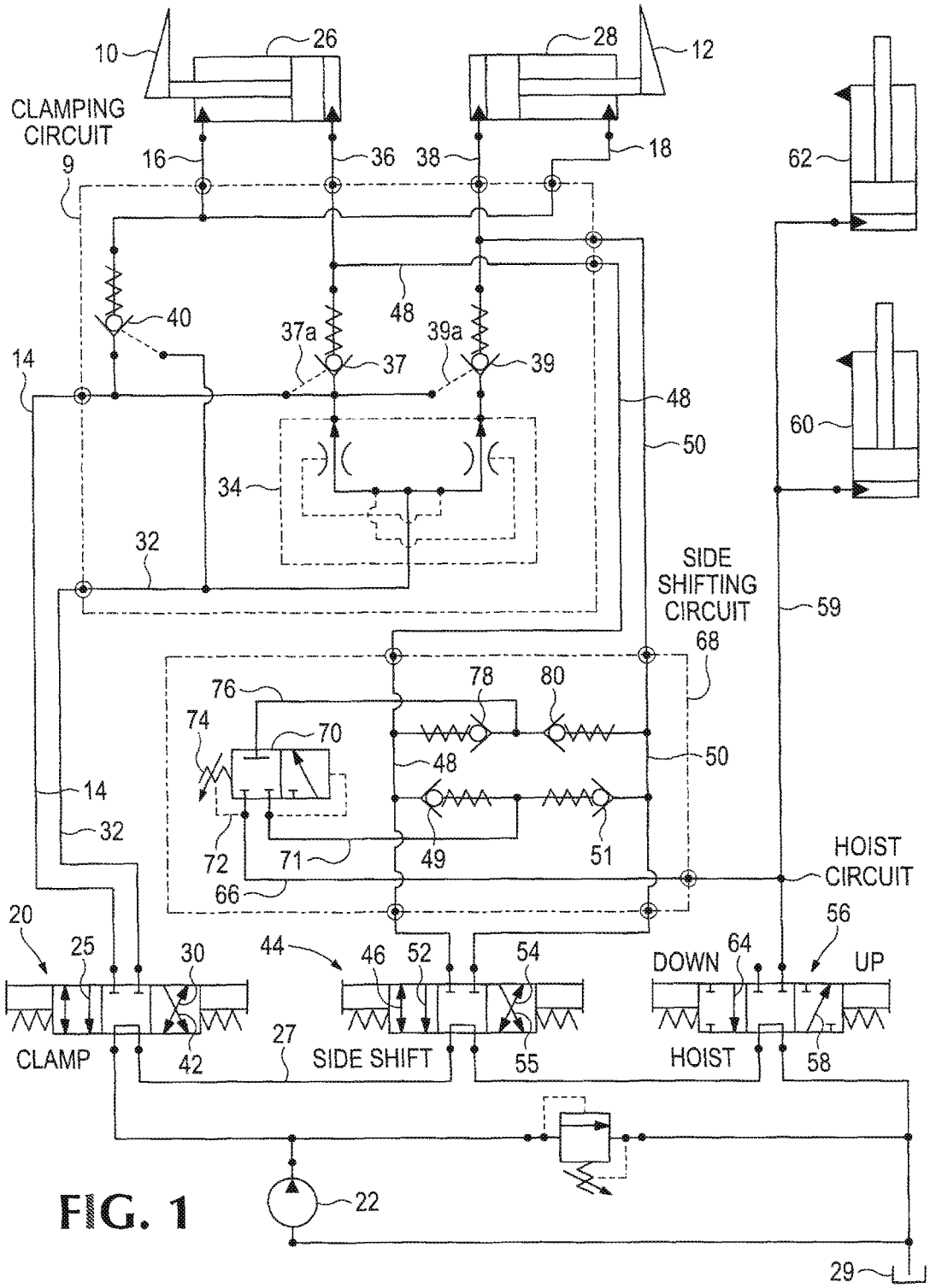
FIG. 1 is a hydraulic circuit diagram exemplifying a load-handling clamp assembly in an integral combination with a clamp side-shifting assembly, and also showing a load hoisting circuit, all operable in accordance with the present invention.

The hydraulic arrangement shown in FIG. 1 exemplifies a typical integral load clamping circuit 9 for controlling a pair of clamp arms 10, 12 each laterally movable selectively toward or away from each other for selectively clamping or unclamping a load (not shown) between them. The clamp arms are laterally closable toward each other to clamp a load by the introduction of pressurized hydraulic fluid through lines 14, 16 and 18 from a manually or electrically controlled clamp valve 20 which, upon movement toward the right in FIG. 1, introduces hydraulic fluid under pressure from pump 22 through clamping lines 14, 16 and 18 to move pistons 26 and 28 toward each other to clamp a load. During the foregoing clamping movements of the pistons 26 and 28, hydraulic fluid is exhausted from the opposite sides of the pistons 26 and 28 through lines 36 and 38 respectively, through pilot operated check valves 37 and 39 respectively, and through a conventional flow divider/combiner valve 34 to line 32, from which the fluid is exhausted through valve passageway 25 of clamp valve 20 and exhaust line 27 to a hydraulic fluid reservoir 29.

Conversely, upon movement of valve 20 to the left in FIG. 1, pressurized hydraulic fluid is introduced from pump 22 through valve passageway 30 and line 32, flow divider/combiner valve 34, and lines 36 and 38 to move the pistons 26 and 28, and their corresponding clamp arms 10 and 12, away from each other thereby opening the clamp arms 10 and 12. During the clamp-opening process, hydraulic fluid is exhausted from the pistons 26 and 28 and through lines 16 and 18, through a pilot-operated check valve 40 opened by pressure in line 32, and through line 14 and valve passageway 42 to exhaust line 27 and hydraulic reservoir 29.

As also exemplified in the integral arrangement of FIG. 1, the clamp arms 10, 12 are laterally movable bidirectionally in unison selectively either to the left or right in FIG. 1 while the load-clamping valve 20 is closed, so as to perform a side-shifting function, either while clamping a load or without any load. In the exemplary hydraulic circuit shown in FIG. 1, upon movement of the side-shifting control valve 44 to the right, hydraulic fluid under pressure is introduced from pump 22 and line 27 through the side-shift valve passageway 46, side-shifting line 48 and thus to line 36, thereby imposing leftward pressure on the piston 26. Whether or not the clamp arms 10, 12 are currently clamping a load, the leftward pressure on piston 26 causes clamping fluid in line 16 to be transferred to line 18 of the other clamping cylinder, thereby causing corresponding leftward pressure also on piston 28 and the exhaustion of fluid from line 38 through line 50 and valve passageway 52 to the hydraulic reservoir 29, so that the pistons 26 and 28 side-shift to the left in unison. No leakage of the fluid is permitted through clamping line 14 during the foregoing left side-shifting process because the pilot-operated check valve 40 preserves the clamping pressure.

Conversely, upon activation of valve 44 to the left in the figure, pressurized hydraulic fluid is similarly introduced from pump 22 and line 27 through valve passageway 54 of valve 44, right side-shifting line 50 and line 38, thereby imposing rightward pressure on the piston 28. Whether or not the clamp arms 10, 12 are currently clamping a load, the rightward pressure on piston 28 can nevertheless cause clamping fluid in line 18 to be transferred to the corresponding opposite line 16 of the other clamping cylinder, thereby causing corresponding rightward pressure on piston 26 and the exhaustion of fluid from line 36 through line 48 and valve passageway 55 to the hydraulic reservoir 29, so that the pistons 26 and 28 side-shift in unison to the right. No leakage of the fluid is permitted through clamping line 14 during right side-shifting because pilot-operated check valve 40 preserves the clamping pressure as mentioned above.

In FIG. 1, a load hoist valve 56, if moved to the left, selectively conducts hydraulic load-lifting pressurized fluid from line 27 through valve passageway 58 and line 59 to one or more load-hoisting hydraulic cylinders such as 60, 62 which lift the load clamp 10, 12. Movement of the valve 56 to the right exhausts fluid from line 59 through valve passageway 64 to the hydraulic reservoir 29, thereby lowering the clamp 10, 12. The load-hoisting cylinders can have any suitable arrangement, including "free lift" cylinder arrangements having different piston diameters for extending sequentially.

The longstanding problem referred to in the foregoing Background of the Invention is solved herein by load-weight responsive side-shifting systems exemplified by a side-shifting force control circuit 68 shown in the various FIGS. 1-4. The variable weights of the loads may be sensed preferably, but not necessarily, from variable hydraulic pressure in hoist line 59 through a sensing line 66 of a side-shifting force control circuit 68. Progressively lower load weights, as sensed through lines 66 and 72, automatically progressively decrease the side-shift pressure relief setting of a valve 70, controlled by a valve spring 74, from its higher settings normally tending to hold the pressure relief valve 70 closed as shown in FIG. 1. In response to such decrease in the side-shift relief pressure setting of relief valve 70, valve 70 opens and thereby relieves the side-shifting pressure in line 71, representing the highest pressure in lines 48 or 50 as sensed between check valves 49 and 51, through line 76 and whichever check-valve 78 or 80 and line 48 or 50 is not exposed to side shifting pressure from valve 44 and therefore can exhaust fluid through valve 44 to reservoir 29.

Thus with a lower-weight load, where the clamping pressure can likewise be safely lower, the side-shifting pressure in either of lines 48 or 50 is variably limited by the automatically variable relief setting of the valve 70 in response to the variable weight of the load, as sensed through lines 66 and 72. This solves the problem, described previously in the Background of the Invention, whereby, when reduced hydraulic clamping pressure is needed for a lighter or more fragile load, but the hydraulic side-shifting pressure is not automatically limited by a side-shifting pressure-relief circuit such as 68, the resultant high side-shifting pressure could harmfully cause a reduction in clamping force by opposing the clamping force, thereby possibly causing an elevated clamped load to slip or fall from the clamp during side-shifting.

It should be recognized that the foregoing solution is intended to interfere only with the unintended consequences of the clamp's side-shifting circuit, and is purposely prevented from interfering with the clamping function of the load clamping circuit as controlled by clamp valve 20. This separation of functions is accomplished by the pilot-operated check valve 40 in the load clamping circuit which isolates the clamping pistons 26 and 28 from any decrease in clamping pressure other than as dictated by the load clamping valve 20 to unseat the check valve 40 by applying pressure through line 32.

Non-Integral Embodiments

Figure 2:
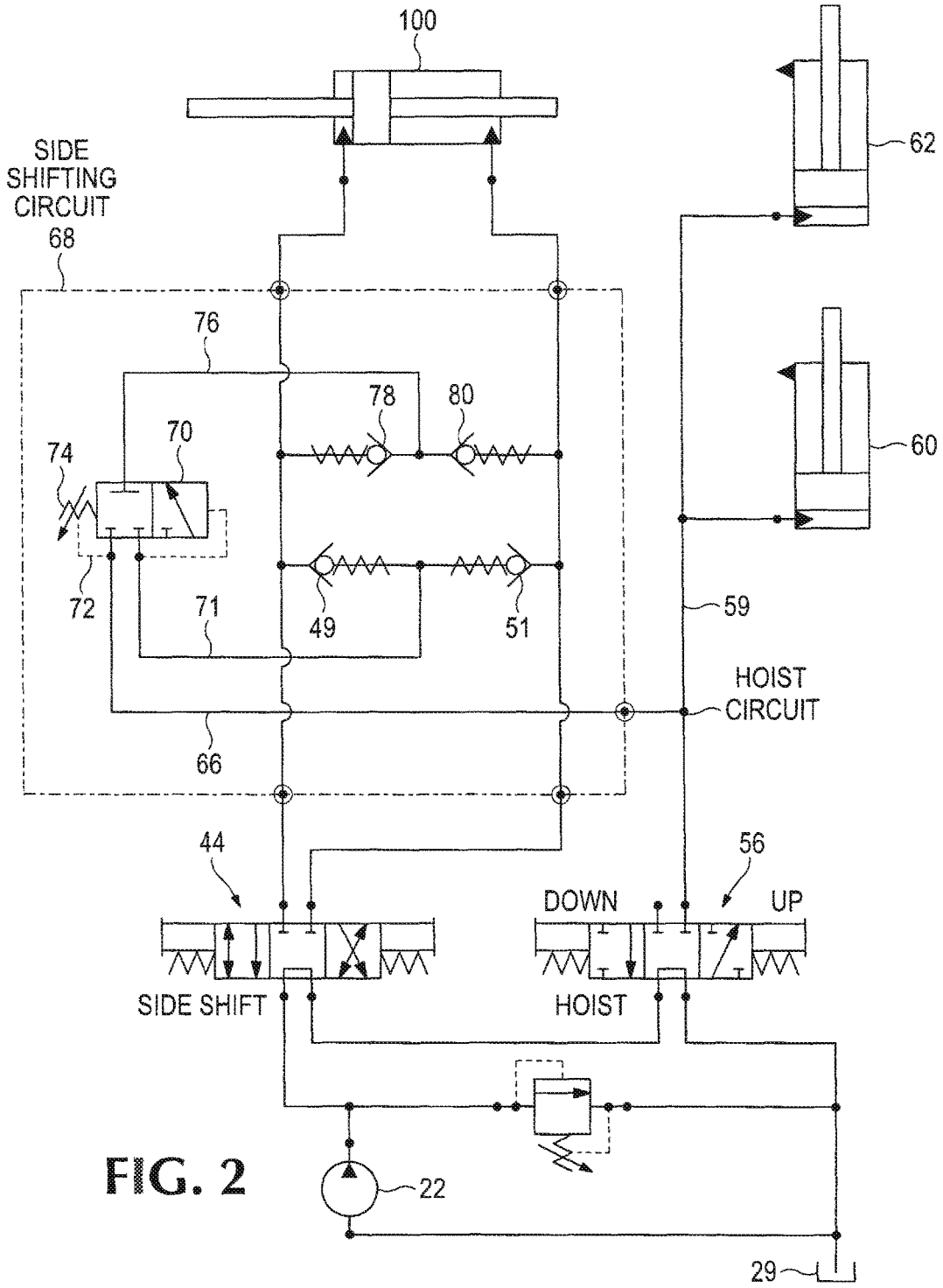
FIG. 2 is a hydraulic circuit diagram exemplifying a non-integral side-shifting assembly in place of the integral side-shifting assembly of FIG. 1, omitting the load-handling clamp assembly for purposes of clarity and also operable in accordance with the present invention.

FIG. 2 shows an exemplary alternative side-shifting circuit with a reversible side-shifting linear actuator 100, which need not be integral with the exemplary clamp circuit 9 (not shown). Instead the side-shifting circuit can, if desired, be part of a separate attachment to the lift truck or other load-carrying vehicle, usable in conjunction with a side-shifting unit or as part of a side-shifting unit, possibly together with other attachments which utilize side-shifting such as bale clamps, fork clamps, paper roll clamps, and so forth.

Figure 3:
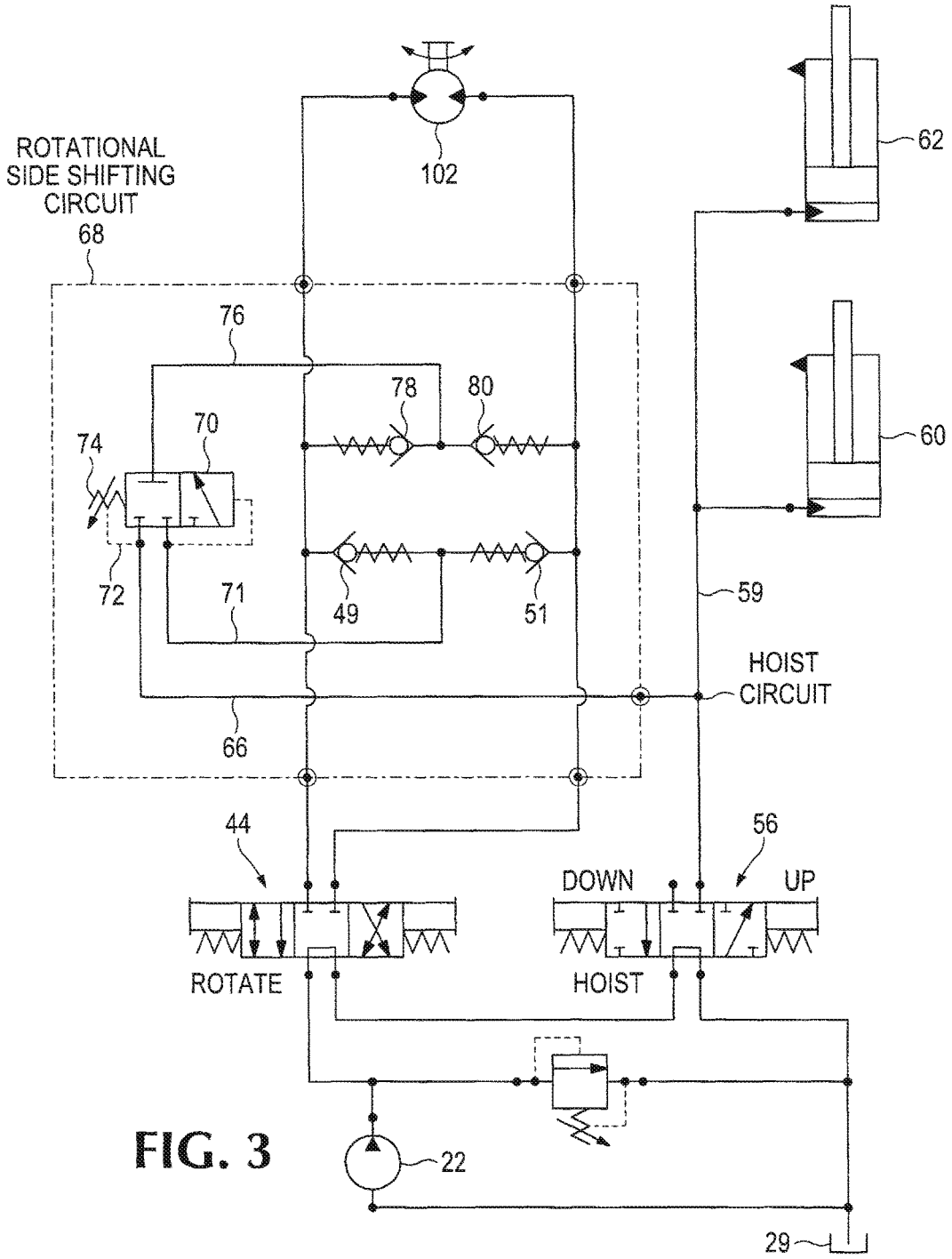
FIG. 3 is a hydraulic circuit diagram similar to FIG. 2 except that its exemplary non-integral side-shifting assembly utilizes a bidirectional rotary hydraulic motor to perform the side-shifting function.

FIG. 3 shows a further exemplary alternative side-shifting circuit with a reversible rotary hydraulic motor 102 capable of performing a side-shifting function, and which need not be integral with the clamp circuit 9.

Figure 4:
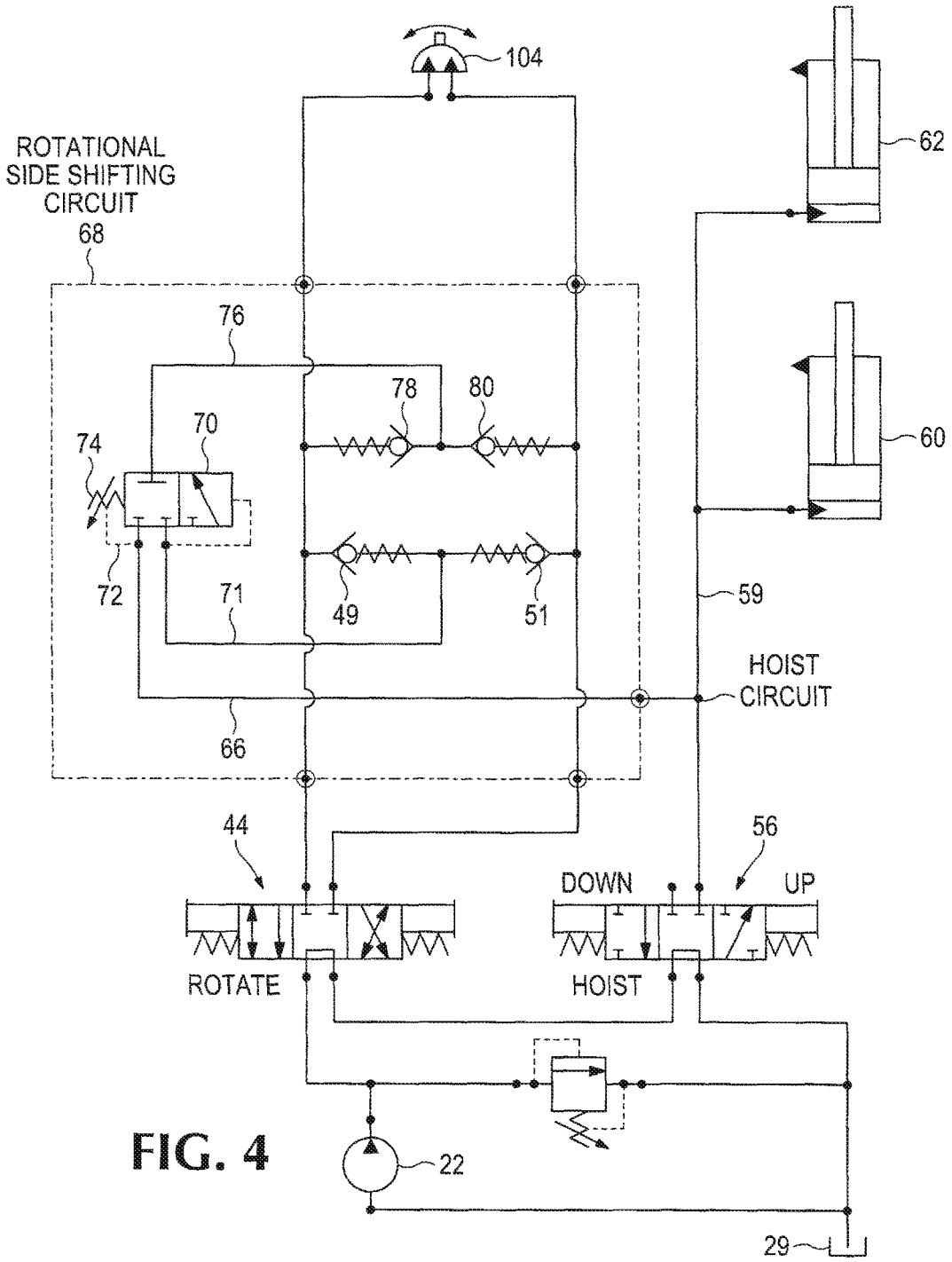
FIG. 4 is a hydraulic circuit diagram similar to FIG. 2 except that its exemplary non-integral side-shifting assembly utilizes a reciprocating rotary hydraulic motor to perform the side-shifting function.

FIG. 4 shows a further exemplary alternative side-shifting circuit with a rotationally reciprocating hydraulic motor 104 capable of performing a curved side-to-side swinging motion for layer-picking load clamps, and which need not be integral with the clamp circuit 9. Another example of such a layer picking application could be a telescopic boom clamping force control.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow. In particular, all of the foregoing embodiments are shown as being hydraulic in nature because of the predominant use of hydraulic actuators in load-handling applications. However, equivalent electrical actuators, and/or electrical control systems, could alternatively be used in such load-handling applications to perform similar functions to those described herein, as would be recognized by those skilled in the art. Accordingly, such equivalent electrical actuators and control systems are intended to be covered by the claims which follow.

What is claimed is:

1. A control system comprising a load-handling clamp assembly having opposed load-clamping arms movable laterally selectively toward and away from each other, and in unison with each other along a common lateral direction, said control system comprising a side-shifting force control circuit configured to decrease a side-shifting pressure progressively in response to lower load weights, the side-shifting force control circuit containing a pressure relief valve that opens to relieve the side-shifting pressure, and a sensor assembly capable of sensing a weight of a load supported between said load-clamping arms and, automatically in response to said weight, variably limiting a force by which said opposed load-clamping arms are movable laterally selectively toward and away from each other, and alternatively in unison with each other, along said common lateral direction.

2. The control system of claim 1 wherein said control system is capable of variably limiting said force hydraulically.

3. The control system of claim 1 wherein said control system is capable of variably limiting said force by limiting force applied by plural actuators to move said pair of clamp arms in unison with each other along said common direction.

4. The control system of claim 3 wherein said control system is capable of variably limiting said force hydraulically.

5. The control system of claim 1 wherein said control system is capable of variably limiting said force by limiting force applied by a single actuator to move said pair of clamp arms in unison with each other along said common direction.

6. The control system of claim 5 wherein said control system is capable of variably limiting said force hydraulically.

7. The control system of claim 1 wherein said control system is capable of variably limiting said force by limiting force applied by an actuator to move said pair of clamp arms in unison with each other along a curved direction.

8. The control system of claim 7 wherein said control system is capable of variably limiting said force hydraulically.

* * * * *